US011945616B2

(12) United States Patent
Patz et al.

(10) Patent No.: US 11,945,616 B2
(45) Date of Patent: Apr. 2, 2024

(54) PACKAGING SYSTEM AND METHOD FOR FEEDING CARDBOARD BLANKS

(71) Applicant: MULTIVAC SEPP HAGGENMUELLER SE & CO. KG, Wolfertschwenden (DE)

(72) Inventors: Dominik Patz, Kempten (DE); Robert Maier, Babenhausen (DE)

(73) Assignee: Multivac Sepp Haggenmueller Se & Co. KG, Wolfertschwenden (DE)

( * ) Notice: Subject to any disclaimer, the term of this patent is extended or adjusted under 35 U.S.C. 154(b) by 0 days.

(21) Appl. No.: 17/866,173

(22) Filed: Jul. 15, 2022

(65) Prior Publication Data

US 2023/0021787 A1 Jan. 26, 2023

(30) Foreign Application Priority Data

Jul. 20, 2021 (DE) ..... 102021118724.9

(51) Int. Cl.
*B65B 47/06* (2006.01)
*B65B 41/06* (2006.01)
(Continued)

(52) U.S. Cl.
CPC ..... *B65B 47/06* (2013.01); *B65B 41/06* (2013.01); *B65B 41/18* (2013.01); *B65B 43/10* (2013.01);
(Continued)

(58) Field of Classification Search
None
See application file for complete search history.

(56) References Cited

U.S. PATENT DOCUMENTS 11,059,615 B2 7/2021 Moessnang et al.
11,427,363 B2 8/2022 Lutz et al.
2020/0071011 A1* 3/2020 Lutz ..... B65B 35/44

FOREIGN PATENT DOCUMENTS

DE 198 31 068 A1 1/2000
EP 3 109 018 A1 12/2016
(Continued)

OTHER PUBLICATIONS

German Search Report dated Feb. 22, 2022, Application No. 10 2021 118 724.9, Applicant Multivac Sepp Haggenmueller SE & Co. KG, 5 Pages.
(Continued)

*Primary Examiner* — Tanzim Imam
(74) *Attorney, Agent, or Firm* — Brooks Kushman P.C.

(57) ABSTRACT

The disclosure relates to a packaging system comprising a deep-drawing packaging machine configured to produce packages in a production direction, and a feeding system for the deep-drawing packaging machine, wherein the feeding system comprises at least one transport belt device configured to transport cardboard blanks in a transport direction extending transversely to the production direction of the deep-drawing packaging machine into a transfer area formed within a machine frame of the deep-drawing packaging machine, and wherein the feeding system comprises a lifting device arranged in the transfer area for collecting and lifting the cardboard blanks transported into the transfer area by means of the transport belt device, wherein the lifting device has a plurality of independently controllable lifting units positioned one behind the other in the transport direction. Furthermore, the disclosure relates to a corresponding method.

20 Claims, 18 Drawing Sheets

(51) Int. Cl.
*B65B 41/18* (2006.01)
*B65B 43/10* (2006.01)
*B65B 43/30* (2006.01)

(52) U.S. Cl.
CPC ..... *B65B 43/305* (2013.01); *B65B 2220/02* (2013.01)

(56) References Cited

FOREIGN PATENT DOCUMENTS

| | | |
|---|---|---|
| EP | 3 617 076 A1 | 3/2020 |
| EP | 3 626 635 A2 | 3/2020 |

OTHER PUBLICATIONS

European Search Report (with English Machine Translation) dated Oct. 27, 2022, Application No. 22173743.0-1014, Applicant Multivac Sepp Haggenmueller SE & Co. KG, 16 Pages.

* cited by examiner

PACKAGING SYSTEM AND METHOD FOR FEEDING CARDBOARD BLANKS

CROSS-REFERENCE TO RELATED APPLICATIONS

This application claims foreign priority benefits under 35 U.S.C. § 119(a)-(d) to German patent application number DE 10 2021 118 724.9, filed Jul. 20, 2021, which is incorporated by reference in its entirety.

TECHNICAL FIELD

The present disclosure relates to a packaging system and to a method for feeding blanks to a packaging machine.

BACKGROUND

EP 3 617 076 A1 discloses a packaging system comprising a deep-drawing packaging machine and a feeding system for prefabricated cardboard trays. The feeding system is configured to transfer the cardboard trays in a transport direction, which runs transversely to the production direction of the deep-drawing packaging machine, to a lifting mechanism arranged within the machine frame of the deep-drawing packaging machine, which is configured as a height-adjustable conveyor belt, in a predetermined packaging format. The cardboard trays transferred to the lifting mechanism are transferred together to a suction plate which can be moved horizontally within the machine frame of the deep-drawing packaging machine. The suction plate transports the cardboard trays collected on it to a forming station, which is configured to join the respective cardboard trays to a deep-drawn packaging lower part.

In the transfer area of the deep-drawing packaging machine, in this known solution, the cardboard trays are already positioned on the lifting mechanism in a predetermined packaging format, which is formed according to a lane and row division of the deep-drawing packaging machine. The cardboard trays provided in such a way are then lifted as a group, transferred to the suction plate and transported further. This is possible because the predetermined cardboard tray packaging format corresponds to the lane and row division of the deep-drawing packaging machine.

The problem is that the already prefabricated cardboard trays have to be fed to the deep-drawing packaging machine at a predetermined height level due to their tray height, because they are transported into the transfer area below the upper side frame and transferred to the lifting mechanism. Thus, the lifting mechanism operates with a long lifting path length, which can reduce the productivity rate of the packaging system. In addition, the cardboard trays are costly to prefabricate and store before they are used on the deep-drawing packaging machine. Furthermore, it is difficult to transport the cardboard trays precisely in the predetermined packaging format into the transfer area, especially when high conveying speeds are required.

SUMMARY

An object of the disclosure is to provide a packaging system and a method by which the disadvantages described above in connection with the prior art can be eliminated.

The disclosure relates to a packaging system comprising a deep-drawing packaging machine configured to produce packaging in a production direction, and a feeding system for the deep-drawing packaging machine. The feeding system comprises at least one transport belt device configured to transport, in a transport direction transverse to the production direction of the deep-drawing packaging machine, cardboard blanks into a transfer area formed within a machine frame of the deep-drawing packaging machine. Furthermore, the feeding system has a lifting device arranged in the transfer area for collecting and lifting the cardboard blanks transported into the transfer area by means of the transport belt device.

According to the disclosure, the lifting device comprises several independently controllable lifting units positioned one behind the other in the transport direction. This allows the respective lifting units to be adjusted separately, resulting in the technical advantages described below.

The cardboard blanks transported along the transport belt device, which are essentially flat in shape, can be produced cost-effectively, stored in a space-saving manner and fed to the deep-drawing packaging machine in a compact manner. In particular, the flat cardboard blanks can be transported to the transfer area just below the upper frame of the machine frame. Due to their larger supporting surface compared to prefabricated cardboard trays, the flat cardboard blanks can be transported into the transfer area very precisely and at higher conveying speeds. Above all, the cardboard blanks do not slip during transport.

However, the respective flat cardboard blanks transported into the transfer area and provided on the transport belt device in an initial format generally have a larger partition, i.e., larger distances from one another, than the lane partition present transverse to the production direction of the deep-drawing packaging machine. In this case, therefore, the output format of the cardboard blanks fed one after the other to the transfer area does not correspond to the predetermined packaging format of the deep-drawing packaging machine.

The lifting device used on the packaging system according to the disclosure solves this challenge in that it itself comprises several independently controllable lifting units positioned one behind the other in the transport direction of the transport belt device. With these, it is possible to sequentially remove the cardboard blanks transported in one or more rows one behind the other along the transport direction into the transfer area from the transport belt device, so that the cardboard blanks positioned behind them can move up within the transfer area. This enables the respective lifting units and the transport belt device to form the predetermined packaging format.

According to the disclosure, the actual formation of the predetermined packaging format therefore takes place in particular by means of the individual lifting units, which sequentially lift the supplied cardboard blanks from the transport belt device within the transfer area and thus make it possible for the respective cardboard blanks arranged behind them to advance step by step to form the predetermined packaging format. This intermittent lifting and advancing principle forms the basis for forming the predetermined packaging format in a simple manner only within the machine frame of the deep-drawing packaging machine, so that the technical advantages mentioned above in connection with the feeding of cardboard blanks can be maintained.

The lifting and advancing principle used here is based on the knowledge that a cardboard blank corresponding to the predetermined packaging format lying on the transport belt device is lifted by a lifting unit so that a cardboard blank lying immediately behind it on the transport belt device, which is not yet present in accordance with the predetermined packaging format, can advance into a desired position corresponding to the predetermined packaging format, from which it can be lifted in accordance with the predetermined packaging format by another of the separately configured lifting units, and so on.

Consequently, the disclosure offers an economically preferred solution for feeding cardboard blanks precisely to a deep-drawing packaging machine with increased productivity and for further processing them in a transfer area formed therein with regard to a predetermined packaging format. The independently controllable, i.e., individually height-adjustable, lifting units used within the transfer area enable the cardboard blanks fed into the transfer area in the initial format to be sequentially removed from the transport belt device with a view to a lane division of the deep-drawing packaging machine and thus to advance towards one another in order to form the desired lane division.

In particular, the lifting units positioned one behind the other in the transfer area in the transport direction, starting with the lifting unit positioned at the very front in the transport direction, can be controlled individually one after the other to lift the respective cardboard blanks. The flat cardboard blanks transported along the transport direction in an initial format into the transfer area, which in this initial format have a larger partition than the lane partition specified by the deep-drawing packaging machine, can in each case first be brought into a desired collection position by means of the transport belt device and lifted from the transport belt device one after the other counter to the transport direction of the transport belt device by means of the respective lifting units, so that the cardboard blanks still arranged behind them on the transport belt device in the initial format can advance intermittently in the transport direction. The cardboard blank at the very front in the transport direction is positioned and lifted according to the predetermined packaging format, then the next cardboard blank in the row is positioned and lifted according to the predetermined packaging format, and so on. This is repeated until the last cardboard blank or blanks present in the transfer area are positioned and lifted according to the predetermined packaging format. By means of this advancing scheme, it is possible that the cardboard blanks originally present in the initial format can be easily brought into the predetermined packaging format according to the lane division of the deep-drawing packaging machine.

Preferably, the lifting units are each configured to collect and lift several cardboard blanks positioned next to each other transversely to the transport direction. Here, the respective lifting units are configured to simultaneously collect several cardboard blanks positioned next to each other.

According to one embodiment of the disclosure, the lifting units each have at least one folding tool for producing tray parts from the respective cardboard blanks received at the lifting units. In addition to their actual function of collecting the respective cardboard blanks from the transport belt device, the lifting units in this variant thus have the further function of folding the cardboard blanks collected thereon into tray parts. This offers the advantage that the tray parts are produced in the production flow of the packaging system only shortly before they are used at the forming station of the deep-drawing packaging machine, which has proven to be advantageous both upstream and downstream. On the one hand, the feeding of cardboard blanks is absolutely preferred, as explained above, and on the other hand, deformation effects on the folded tray parts can be reduced.

One variant provides that the respective lifting units can be pneumatically controlled separately. For this purpose, the respective lifting units can each have at least one pneumatic cylinder that can be adjusted between a retracted and an extended position. The respective pneumatic cylinders can be arranged in a compact fashion in the transfer area below the transport belt device.

Preferably, the feeding system in the transfer area has at least one adjustable positioning device associated with the transport belt device for aligning the cardboard blanks transported into the transfer area by means of the transport belt device. The positioning device ensures that the cardboard blanks transported into the transfer area are precisely aligned one after the other over the respective lifting units so that they can be optimally collected by them.

The positioning device could, for example, have pneumatically controllable positioning elements, in particular retractable and extendable positioning pins, along the section of the transport belt device formed within the transfer area, which can be retracted and extended independently of one another. It would be conceivable for the positioning elements to be in the form of molded parts, with which the respective cardboard blanks can be guided into a desired position and aligned therein. In the extended state, positioning elements project between belts of the transport belt device and form an alignment aid and a stopper for the cardboard blanks transported on them.

Preferably, the positioning elements can be controlled sequentially one after the other as a function of the lifting and advancing principle of the lifting units, so that the cardboard blanks transported into the transfer area can be advanced one after the other to the respective positioning elements in order to be stopped in contact therewith at the respective collection positions, i.e., exactly above the respective lifting units.

According to one embodiment of the disclosure, it is provided that the feeding system comprises a gripper device mounted within the machine frame of the deep-drawing packaging machine and adjustable between the transfer area and a forming station of the deep-drawing packaging machine. The gripper device is configured, in particular, to collect the folded tray parts and transfer them in the predetermined packaging format to a forming die lower part of the forming station.

In particular, the gripper device has several gripper units configured as suction grippers. Preferably, the gripper units each have at least two suction units which can suck in a tray part produced by means of the folding tool at its base and/or side wall and transport it further. One practical variant provides that the gripper units each have a groove running around their circumference, in which folded edge sections of a tray part can be held. This ensures that the tray parts folded by the folding tool are transferred to the forming station in a dimensionally stable manner, i.e., the folded edge sections do not fold back.

It is conceivable that the gripper device comprises several gripper units that can be jointly adjusted in height and/or several gripper units that can be adjusted relative to one another in the production direction. This makes it possible to jointly collect the tray parts lifted by the respective lifting units into the respective transfer positions by means of the height-adjustable gripper units, thus optimizing process cycle times. For example, the transfer level selected for the transfer can be determined such that the lifting paths of the respective lifting units are reduced to a maximum, taking into account the folding process, wherein the height adjustment of the respective gripper units is adapted in this respect in order to jointly collect the tray parts prefabricated, i.e., folded, during the respective lifting movement.

The aforementioned variant, according to which the gripper has a plurality of gripper units which can be adjusted relative to one another in the production direction of the deep-drawing packaging machine, makes it possible for the tray parts collected on the gripper, even if they have already been collected by means of the gripper units, to still be moved towards one another on the gripper in the production direction of the deep-drawing packaging machine. Thus, a possibly existing partition difference of the respective tray parts collected at the gripper device with regard to the predetermined row partition of the packaging format to be provided to the forming station can be compensated. For this function, it would be conceivable that at least one adjustment mechanism controllable in the production direction of the deep-drawing packaging machine is formed on the gripper device, for example a pneumatically actuated linear drive, by means of which the respective rows of gripper units arranged transversely to the production direction can be moved towards one another. These rows are preferably adjusted simultaneously, in particular during a transfer movement of the gripper unit to the forming station.

Preferably, the transport belt device is in the form of a belt conveyor. The belt conveyor has at least two transport belts mounted parallel to each other. The cardboard blanks transported on the belt conveyor into the transfer area can be easily collected by means of the respective lifting units. These can be lifted between the transport belts of the belt conveyor in order to collect and lift the respective cardboard blanks from the belt conveyor.

The belt conveyor can be controlled in particular such that the cardboard blanks deposited thereon are made available in the above described advancing process, one after the other and with a time delay, at their respective collection positions above the lifting units, from which they can be collected and lifted one after the other by means of the lifting units. This makes it possible to arrange the respective cardboard blanks relative to one another according to the lane division of the predetermined packaging format, which corresponds to the lane division of the deep-drawing packaging machine.

For precise feeding of the respective cardboard blanks, it would be possible for the transport belt device to be configured as a vacuum belt system. This allows the respective cardboard blanks to be sucked onto the transport belts on their way to the deep-drawing packaging machine, thus enabling high adjustment speeds and accelerations. Alternatively, the transport belts could be designed as smooth plastic belts with drivers.

Furthermore, the disclosure relates to a method for feeding cardboard blanks arranged in a row one behind the other in a transport direction into a transfer area formed within a machine frame of a deep-drawing packaging machine. According to the disclosure, a cardboard blank positioned in the row is transported within the transfer area in the transport direction into a first collection position and is lifted out of this position before a cardboard blank positioned in the row immediately behind it in the transport direction advances within the transfer area in the transport direction into a second collection position.

Using this conveying concept, cardboard blanks transported into the transfer area in an initial format can be brought into close ranks with regard to a predetermined lane division of the deep-drawing packaging machine, i.e., into a predefined packaging format. In particular, the technical challenge that the cardboard blanks transported into the transfer area in the initial format have a larger partition than the lane division of the deep-drawing packaging machine can thus be easily solved. This results in technical advantages both outside the deep-drawing packaging machine and inside the deep-drawing packaging machine for the transport and further processing of the cardboard blanks. Above all, the cardboard blanks can be prepared more cost-effectively outside the deep-drawing packaging machine and fed to the deep-drawing packaging machine in a compact manner. Furthermore, this creates advantages in particular in terms of quality and economy, since the respective cardboard blanks can only be folded into tray parts within the deep-drawing packaging machine, i.e., in the production flow near the forming station, and these can be transferred directly to the forming station in the predetermined packaging format.

A preferred variant provides that the cardboard blank transported into the first collection position is lifted out of the collection position, folded and moved as a tray part into a first transfer position before the cardboard blank positioned immediately behind it in the row advances within the transfer area in the transport direction into the second collection position. By means of this advancing principle, the respective cardboard blanks arranged within the transfer area can be collected individually one after the other by the transport belt device from an advancing position, folded and lifted into the respective transfer positions, so that they are displaced within the transfer area relative to their initial format into a packaging format that is arranged in close ranks in the transport direction, in which they are arranged as tray parts in their respective transfer positions.

One variant provides for several rows formed side by side in the transport direction with cardboard blanks positioned one behind the other therein to be transported simultaneously into the transfer area as a packaging format, wherein a plurality of adjacent cardboard blanks transverse to the transport direction are transported simultaneously with one another in the transport direction into respective first, mutually adjacent collection positions, are lifted out of these, are folded and are moved as tray parts into respective first, mutually adjacent transfer positions, before a plurality of adjacent cardboard blanks positioned immediately therebehind transverse to the transport direction advance simultaneously with one another in the transport direction into respective second, mutually adjacent collection positions, are lifted out of these, are folded and are moved as tray parts into respective second, mutually adjacent transfer positions. This allows cardboard blanks transported in multiple rows and simultaneously in multiple lanes into the transfer area to be positioned one after the other in rows aligned in the production direction, lifted, folded and lifted into the respective transfer positions for transfer to the gripper device.

BRIEF DESCRIPTION OF THE DRAWINGS

Embodiments according to the disclosure are explained in more detail below by means of the Figures.

Identical components are identified throughout the Figures by the same reference signs.

DETAILED DESCRIPTION

Figure 1:
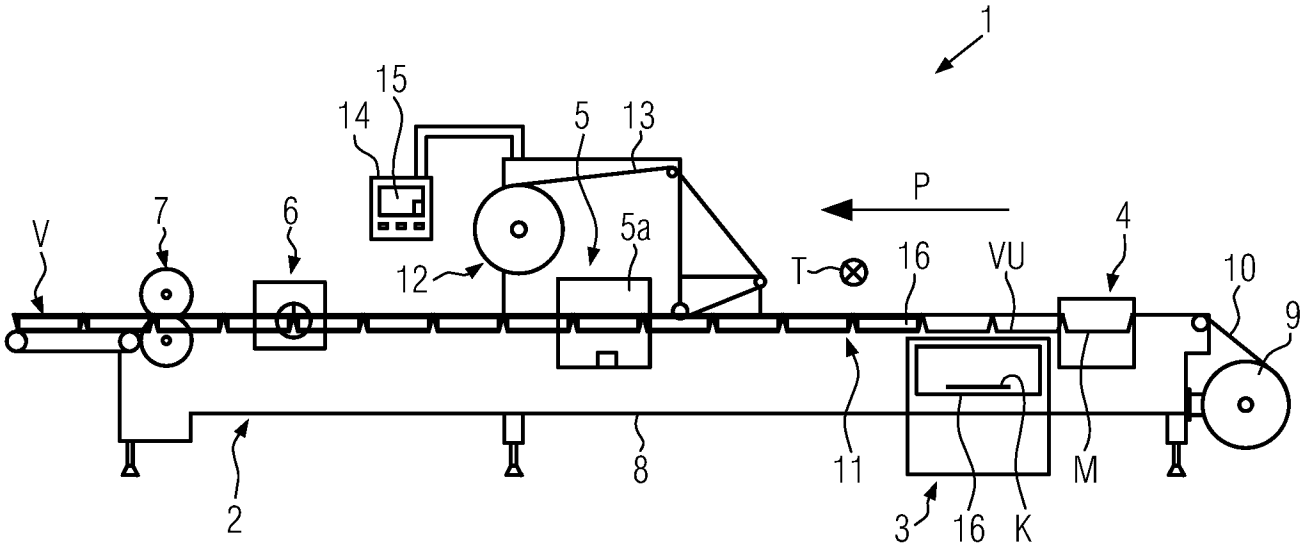
FIG. 1 shows a schematic side view of a packaging system according to the disclosure.

FIG. 1 shows a schematic side view of a packaging system 1 which comprises an intermittently operating deep-drawing packaging machine 2 and a feeding system 3 for the deep-drawing packaging machine 2. The deep-drawing packaging machine 2 has a forming station 4, a sealing station 5, a transverse cutting device 6 and a longitudinal cutting device 7, which are arranged in this order in a production direction P on a machine frame 8. On the input side, a feed roll 9 is located on the machine frame 8, from which a lower film 10 is drawn off. In the embodiment shown, the forming station 4 is configured as a deep-drawing station in which troughs M are formed in the lower film 10 by deep-drawing, for example by means of compressed air and/or vacuum. In this context, the forming station 4 can be configured such that several troughs M are formed next to one another in the direction perpendicular to the production direction P. A filling path 11 is provided downstream of the forming station 4 in the production direction P, in which the troughs M formed in the lower film 10 are filled with product.

The sealing station 5 has a hermetically sealable chamber 5*a* in which the atmosphere in the troughs M can be evacuated and/or replaced, for example, by gas purging with an exchange gas or with a gas mixture before sealing with the upper film 13 dispensed from an upper film holder 12.

The transverse cutting device 6 can be configured as a die cutter which cuts the lower film 10 and the upper film 13 in a direction transverse to the production direction P between adjacent troughs M. The upper film 13 is cut by the transverse cutting device 6. The transverse cutting device 6 operates in such a way that the lower film 10 is not cut across its entire width, but is not cut through at least in an edge region. This enables controlled onward transport.

The longitudinal cutting device 7 can be configured as a knife arrangement with which the lower film 10 and the upper film 13 are cut between adjacent troughs M and at the lateral edge of the lower film 10 in the production direction P, so that separated packages V are present downstream of the longitudinal cutting device 7.

Furthermore, the deep-drawing packaging machine 2 shown in FIG. 1 has an operating terminal 14 at which process parameters can be set for the respective work stations provided on the deep-drawing packaging machine 2. The operating terminal 14 comprises a control device 15 shown only schematically. The control device 15 is configured to perform computing operations, in particular in real time during the packaging process, in order to control the deep-drawing packaging machine 2 based thereon. The control device 15 of the deep-drawing packaging machine 2 is also configured to control the feeding system 3 shown in FIG. 1.

The feeding system 3 shown only schematically in FIG. 1 has a transport belt device 16 which is configured to feed cardboard blanks K to the deep-drawing packaging machine 2 in a transport direction T running transversely to the production direction P of the deep-drawing packaging machine 2. These cardboard blanks K, which are shown in a flat form in FIG. 1, are folded into tray parts S (see FIG. 3) within the deep-drawing packaging machine 2 and joined together with the troughs M, which are deep-drawn within the forming station 4, to form composite packaging lower parts VU.

Figure 2:
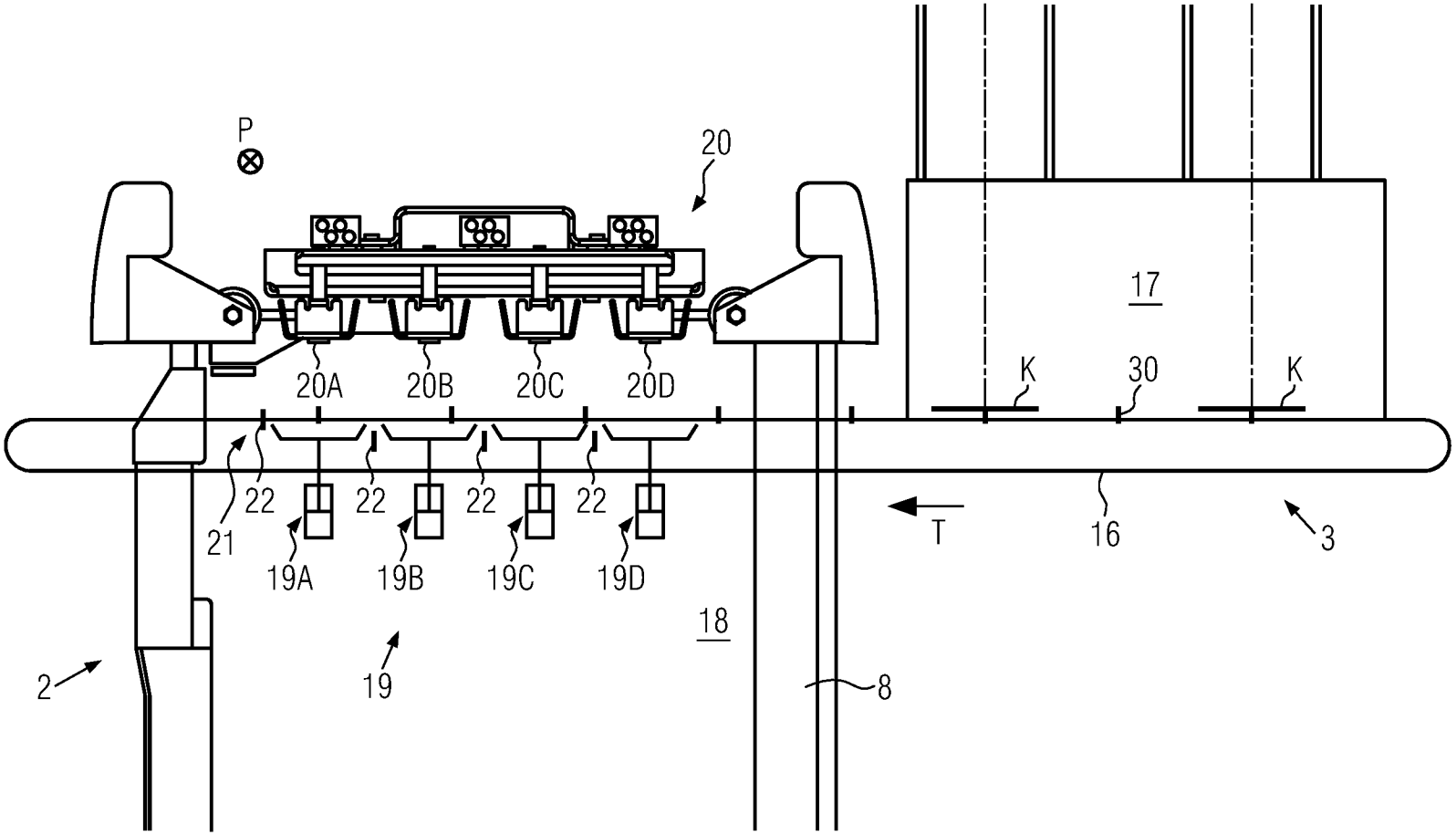
FIG. 2 shows a schematic cross-sectional view of the transfer area formed inside the deep-drawing packaging machine.

FIG. 2 shows that the transport belt device 16 has drivers 30. The transport belt device 16 receives the cardboard blanks K from a destacker 17 in order to transport them in the transport direction T into a transfer area 18 formed within the machine frame 8 of the deep-drawing packaging machine 2. Within the transfer area 18, the feeding system 3 has a lifting device 19 which is configured to collect and lift the cardboard blanks K transported into the transfer area 18 by means of the transport belt device 16. A gripper device 20 is arranged above the lifting device 19. The gripper device 20 has height-adjustable gripper units 20A, 20B, 20C, 20D which are configured to cooperate with the lifting device 19, in particular with lifting units 19A, 19B, 19C, 19D formed separately thereon. Both the lifting units 19A to 19D and the gripper units 20A to 20D can each be in the form of pneumatically operated units.

Furthermore, FIG. 2 shows a schematic representation of a positioning device 21, which is assigned to the transport belt device 16 within the transfer area 18. The positioning device 21 can also be pneumatically controlled. As shown in FIG. 2, the positioning device 21 has four positioning pins 22 assigned to the transport belt device 16 one behind the other in the transport direction T. The positioning pin 22 arranged at the very front in the transport direction T is positioned extended, while the positioning pins arranged behind it in the transport direction T are lowered. A cardboard blank K transported in a row into the transfer area 18 and in the first position can be moved against the extended positioning pin in order to assume a desired position and alignment above the lifting unit 19A positioned below it. Cardboard blanks K in the row behind can be moved in succession against the other positioning pins 22 when extended to assume precise alignment above the other respective lifting units 19B, 19C, 19D.

The lifting units 19A, 19B, 19C, 19D shown in FIG. 2 can be controlled independently of one another. This means that the respective lifting units 19A to 19D can be adjusted individually from the position shown in FIG. 2, one after the other, in the direction of the gripper units 20A to 20D positioned above them.

Figure 3:
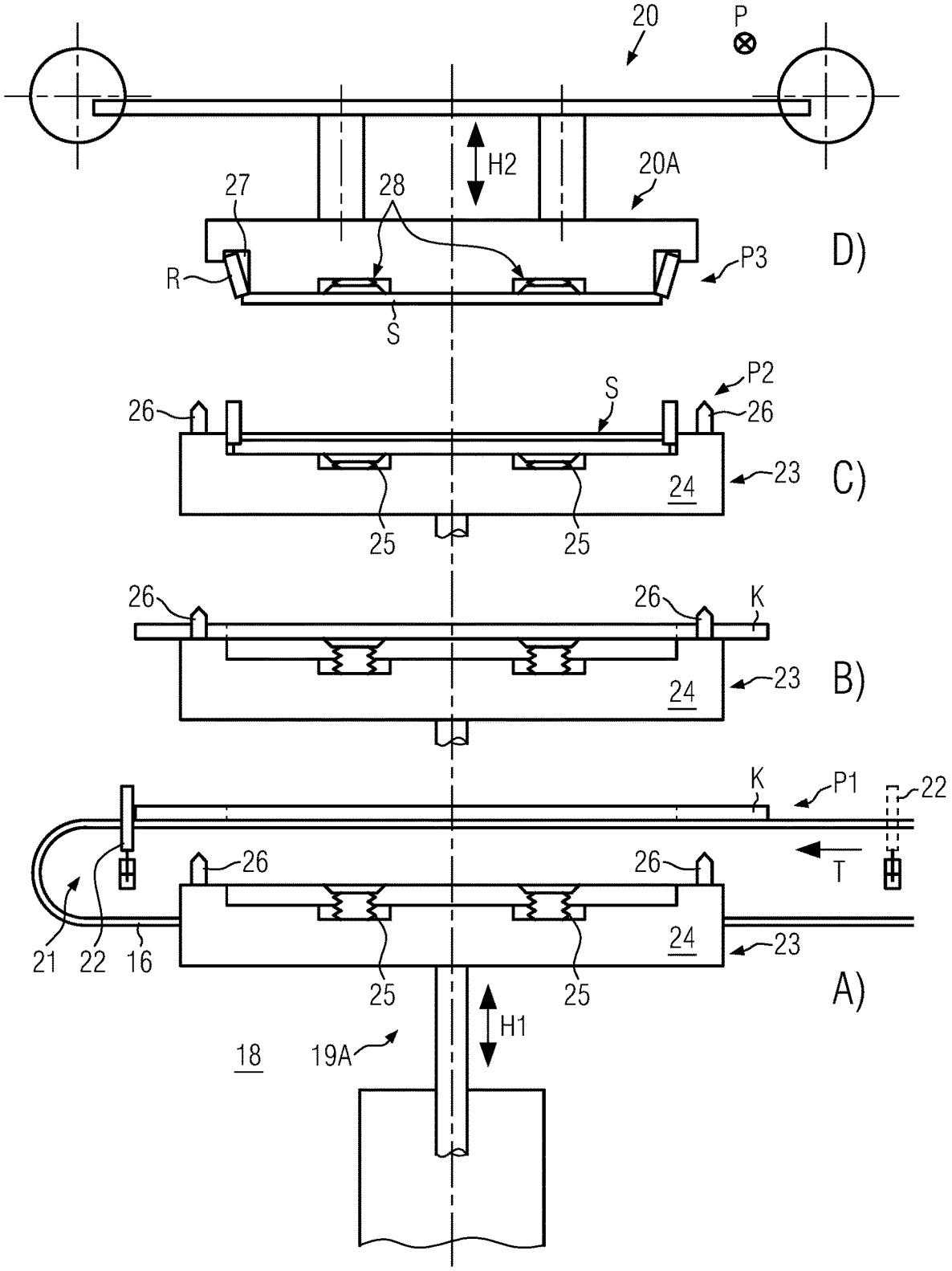
FIG. 3 shows a schematic diagram of the operating mode of a lifting unit.

FIG. 3 shows how a cardboard blank K transported into the transfer area 18 is collected by one of the lifting units 19A to 19D, lifted and simultaneously folded during the lifting movement and finally transferred to one of the gripper units 20A to 20D positioned above it. This sequence is described below in connection with the lifting unit 19A arranged in the very front position in transport direction T.

First, in a first step A, the cardboard blank K is moved above the lifting unit 19A by means of the transport belt device 16 into a collection position P1. For this purpose, the cardboard blank K is moved by the transport belt device 16 into the transfer area 18 until it abuts against the extended positioning pin 22 of the positioning device 21. The cardboard blank K has now arrived precisely in the collection position P1, from which it can be collected by the lifting unit 19A.

The lifting unit 19A shown schematically in FIG. 3 comprises a folding tool 23. The folding tool 23 has a die 24, on the bottom part of which a plurality of pneumatically controllable suction cup units 25 are arranged. Furthermore, the folding tool 23 has a plurality of pins 26 on its circumference. This makes it possible, as shown in step B, to align the cardboard blank K on the folding tool 23.

In step B, the lifting unit 19A, in particular the folding tool 23 formed thereon, is extended further in the lifting direction H. As a result, the folding tool 23 collects the cardboard blank K arranged in the collection position P1 in step A, thereby freeing up its space on the transport belt device 16. By lifting the cardboard blank K, another cardboard blank K positioned in transport direction T behind the cardboard blank K shown in FIG. 3 can now advance in order to achieve a division according to the lane division of the deep-drawing packaging machine 2. The cardboard blank K that advances can move against the positioning pin 22 shown as a dashed line in FIG. 3, which has now been extended.

In step C in FIG. 3, the cardboard blank K positioned on the folding tool 23 is deep-drawn into the die 24. For this purpose, a vacuum is applied to the suction cup units 25. Based on the folding process thus performed, a tray part S is produced from the cardboard blank K.

In step C, the tray part S present therein is positioned in a transfer position P2. The preceding steps A to C can now be carried out or temporarily overlapped for the subsequent cardboard blank K, etc., until all the cardboard blanks K present in the transfer area are positioned in their transfer positions P2.

The tray part S produced during the lifting movement can be collected from the transfer position P2 by means of the gripper unit 20A. The gripper unit 20A is lowered in lifting direction H2 for this purpose. The gripper unit 20A shown in FIG. 3 is configured as a suction gripper. The gripper unit 20A has a circumferential groove 27 in which an edge R of the tray part S can be accommodated. This can prevent the edge R folded on the tray part S from folding back.

The tray part S can be fixed to the gripper unit 20A by means of suction units 28 formed thereon. This is shown in step D. In step D, the tray part S is arranged in a traverse position P3 relative to the transfer position P2 in the lifting direction H2. From the traverse position P3, the tray part S attached to the gripper unit 20A is transported further in the production direction P to the forming station 4 of the deep-drawing packaging machine 2.

Figure 4A:
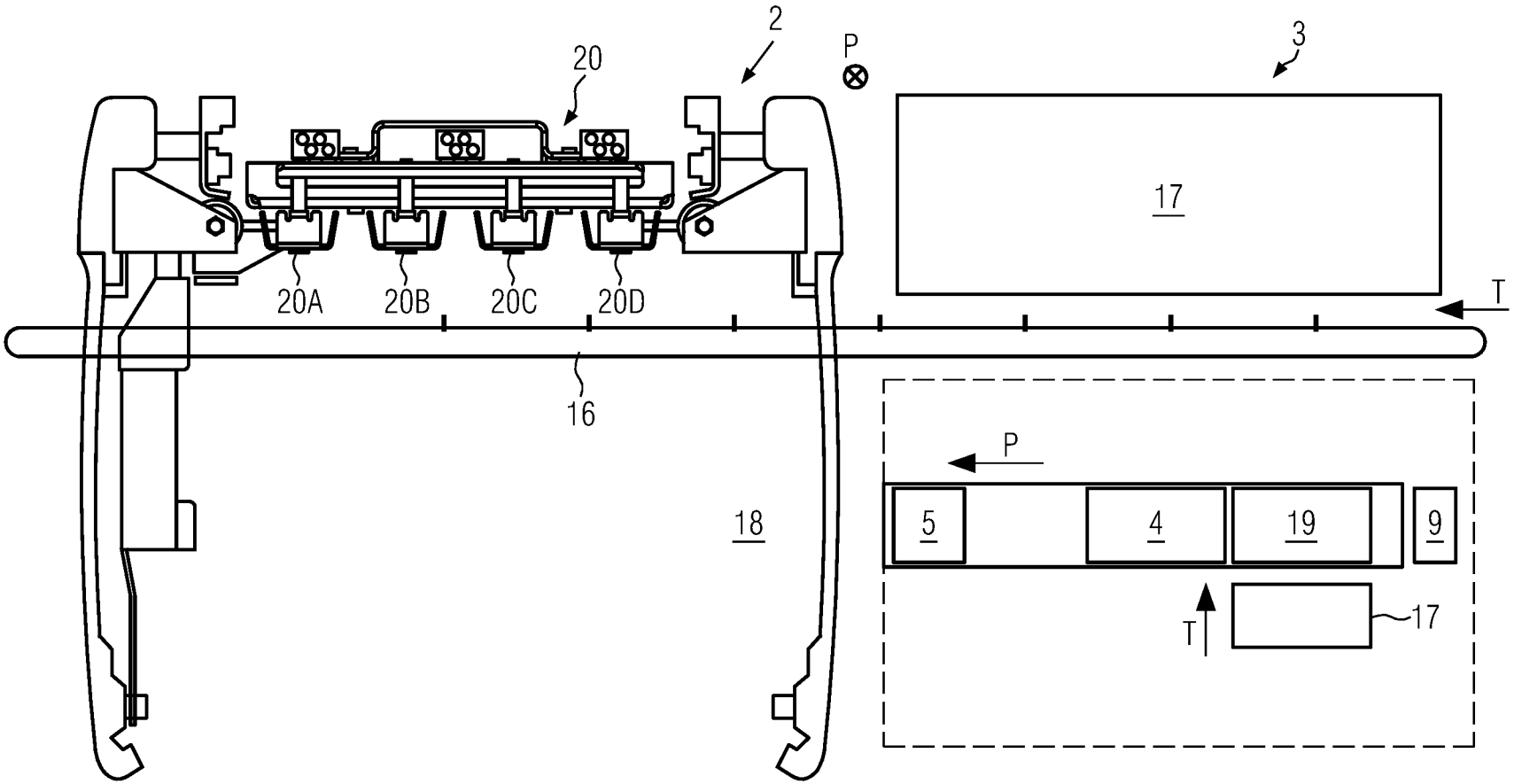
FIGS. 4A-4O show a process flow for forming a predetermined packaging format within the machine frame of the deep-drawing packaging machine.

FIGS. 4A to 4O show how the flat cardboard blanks K fed to the deep-drawing packaging machine 2 can be folded into tray parts S by means of the respective lifting units 19A to 19D and these are transferred to the gripper device 10 in a predefined packaging format F.

FIG. 4A shows a schematic cross-sectional view of the deep-drawing packaging machine 2 in the transfer area 18 and of the feeding system 3, which is configured to feed cardboard blanks K in transport direction T to the transfer area 18. In the dashed outlined window section in FIG. 4A, the deep-drawing packaging machine 2 and the feeding system 3 arranged transversely thereto are shown schematically from the top view.

Figure 4B:
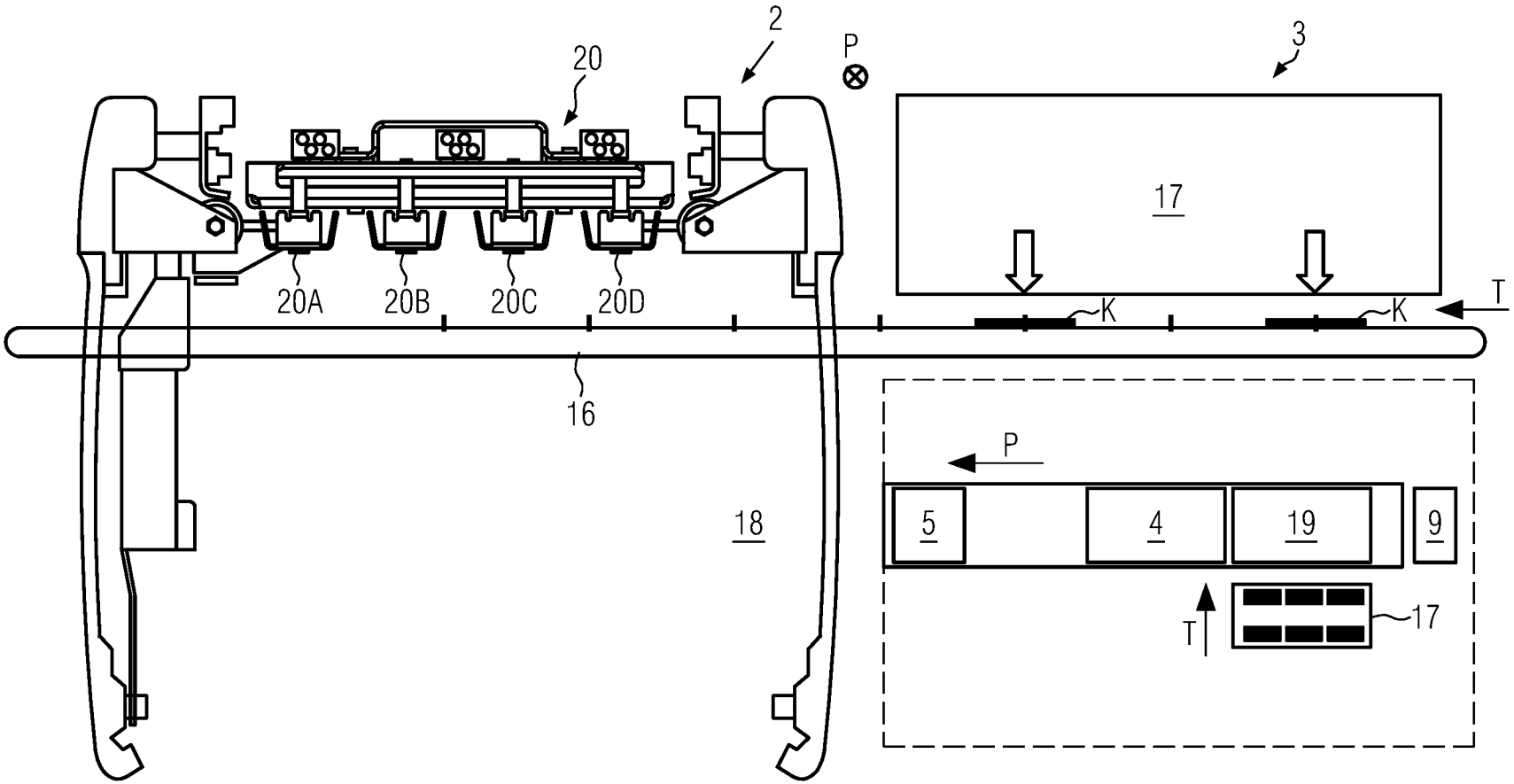

In FIG. 4B, two cardboard blanks K spaced apart from one another are first deposited on the transport belt device 16 by the destacker 17 outside the deep-drawing packaging machine 2. From the top view illustration, it can be seen that there are actually two rows formed one behind the other transversely to the transport device T.

Figure 4C:
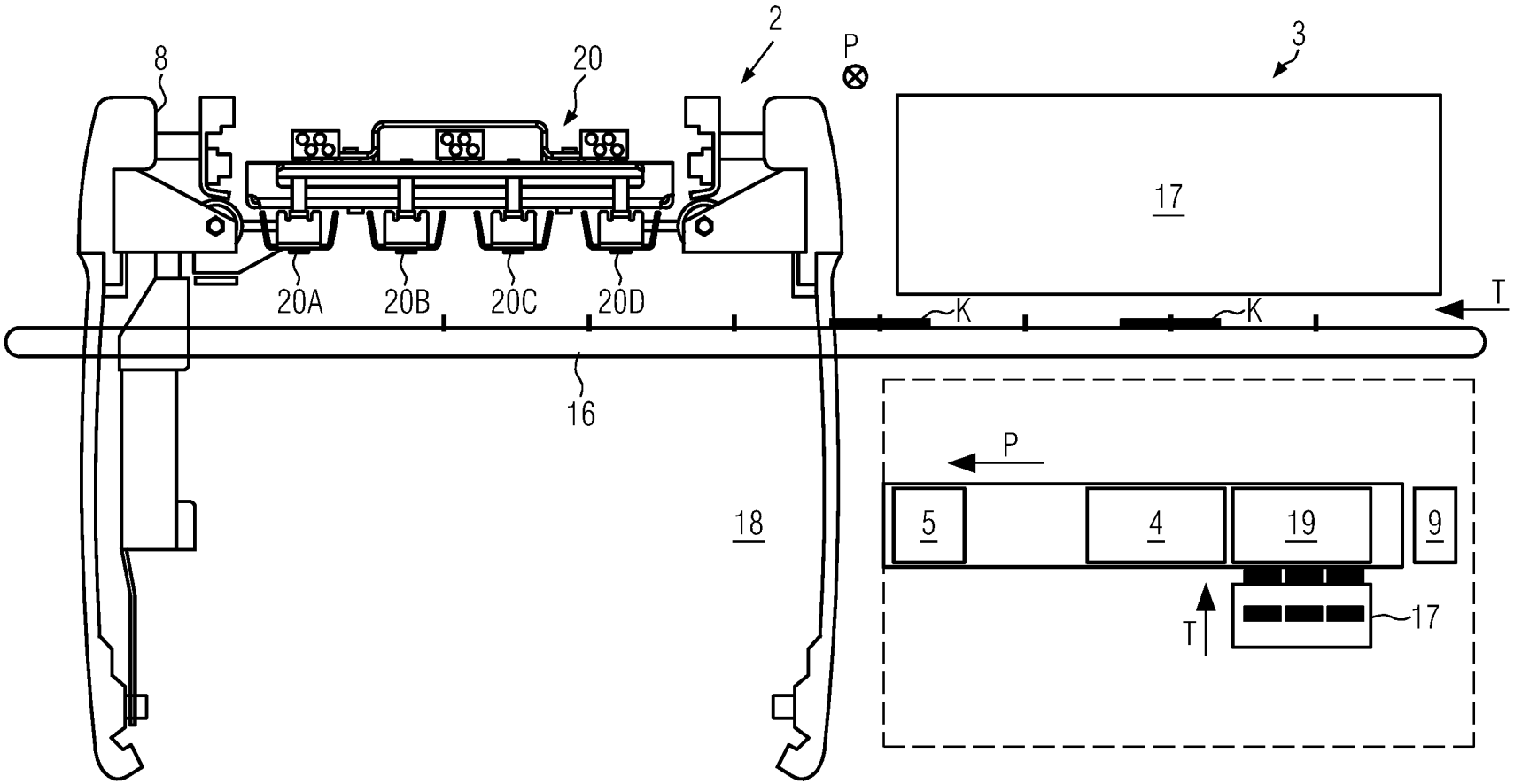

In FIG. 4C, the two rows of cardboard blanks K deposited on the transport belt device 16 are moved in transport direction T.

Figure 4D:
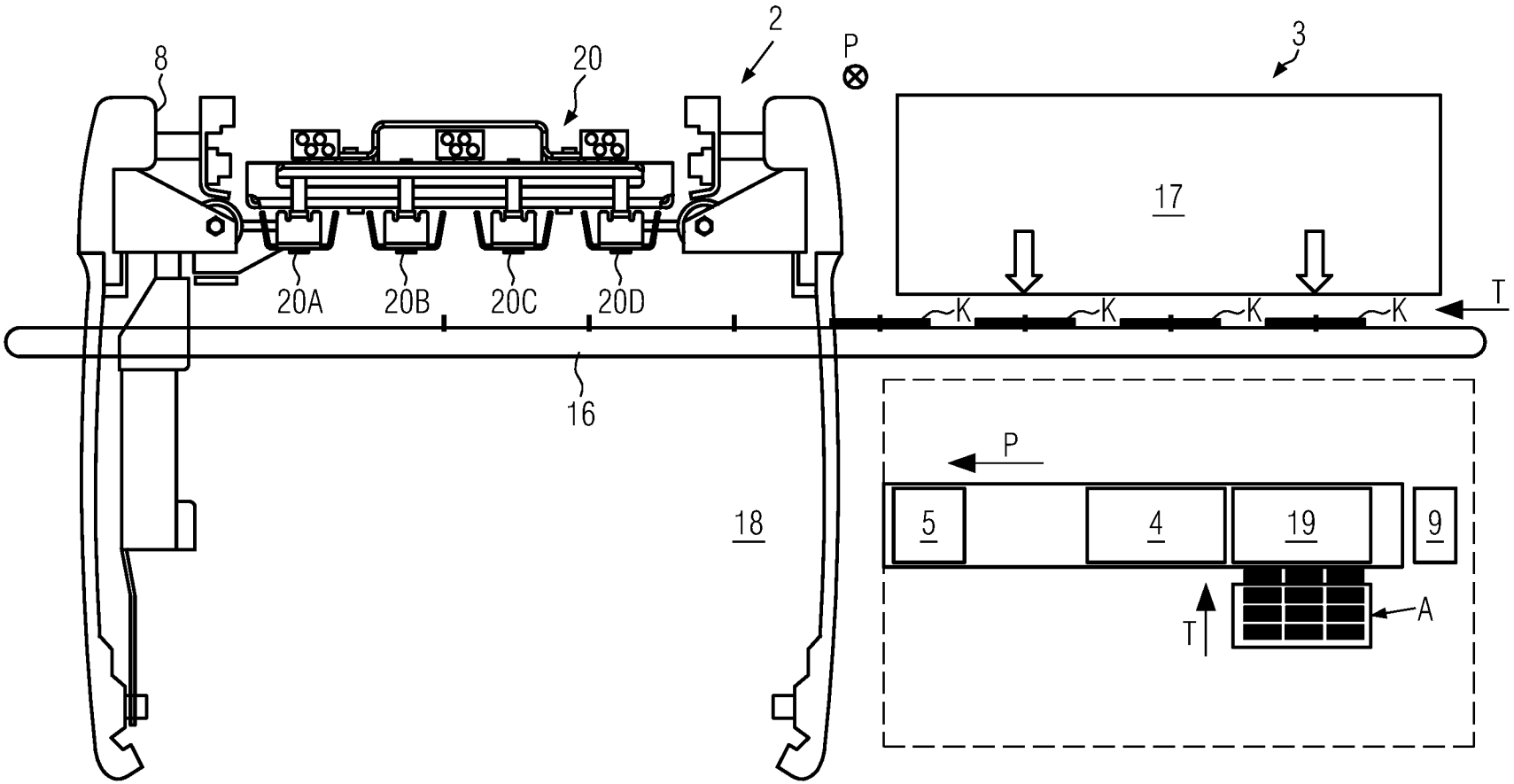

According to FIG. 4D, two further rows of cardboard blanks K are delivered from the destacker 17 to the transport belt device 16. FIGS. 4C and 4D show that the respective rows of cardboard blanks K are deposited on the transport belt device 16 according to an initial format A, which is shown schematically in the top view. For this purpose, the respective rows are discharged from the two magazines formed in the destacker 17 onto the transport belt device 16 in pairs offset relative to one another due to their format.

Figure 4E:
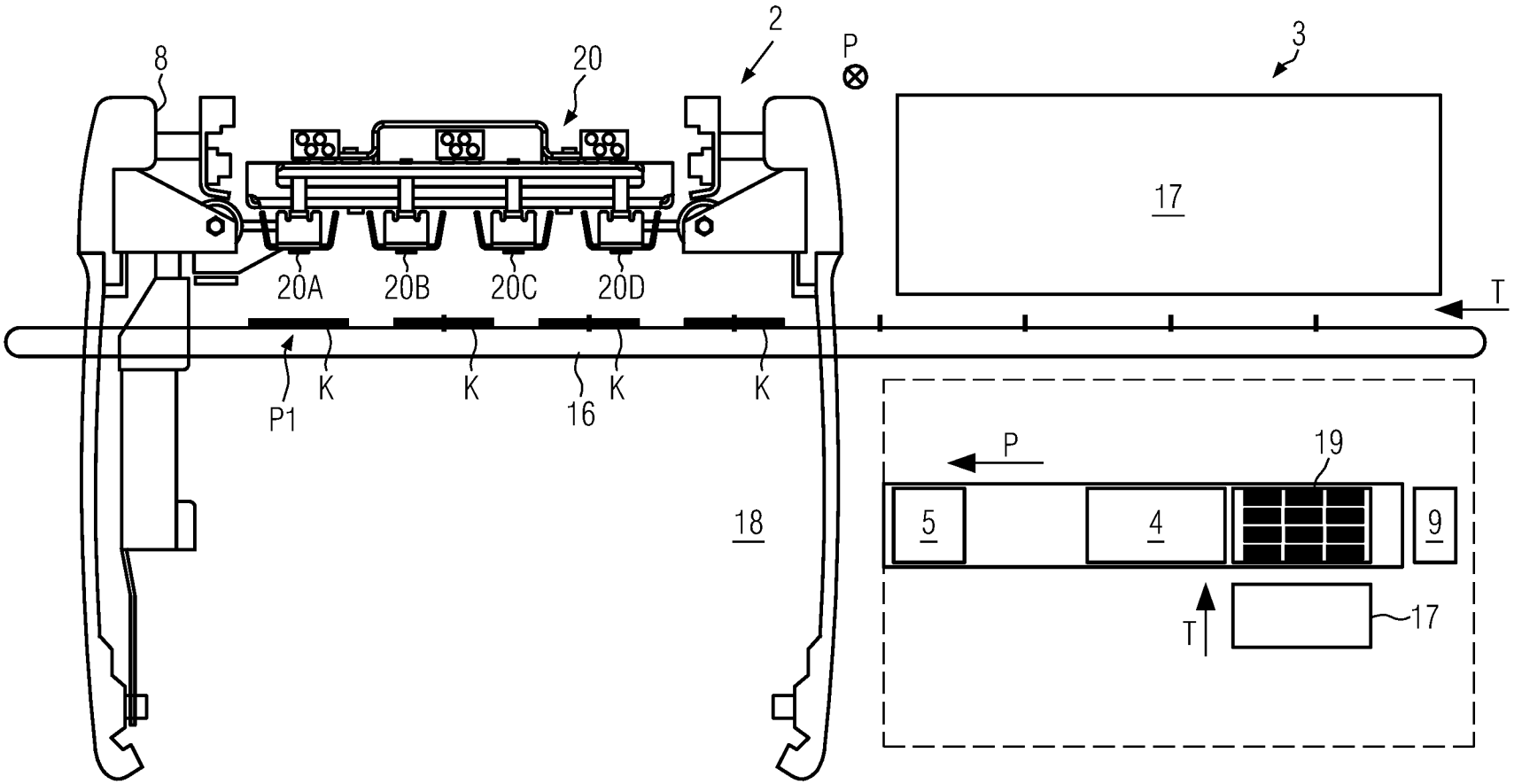

FIG. 4E shows that the initial format A of cardboard blanks K are transported by the transport belt device 16 into the transfer area 18 formed within the machine frame 8 of the deep-drawing packaging machine 2. FIG. 4E shows that the cardboard blank K positioned first within the transfer area 18 in the transport direction T has moved to its collection position P1, in which it is aligned below the gripper unit 20A positioned above it. The other cardboard blanks K positioned behind them are not yet aligned below the respective gripper units 20B, 20C, 20D. Rather, as shown in the following Figures, these cardboard blanks K, which are still arranged in the original initial format A, are moved sequentially to assume an aligned position below the respective gripper units 20B, 20C, 20D.

Figure 4F:
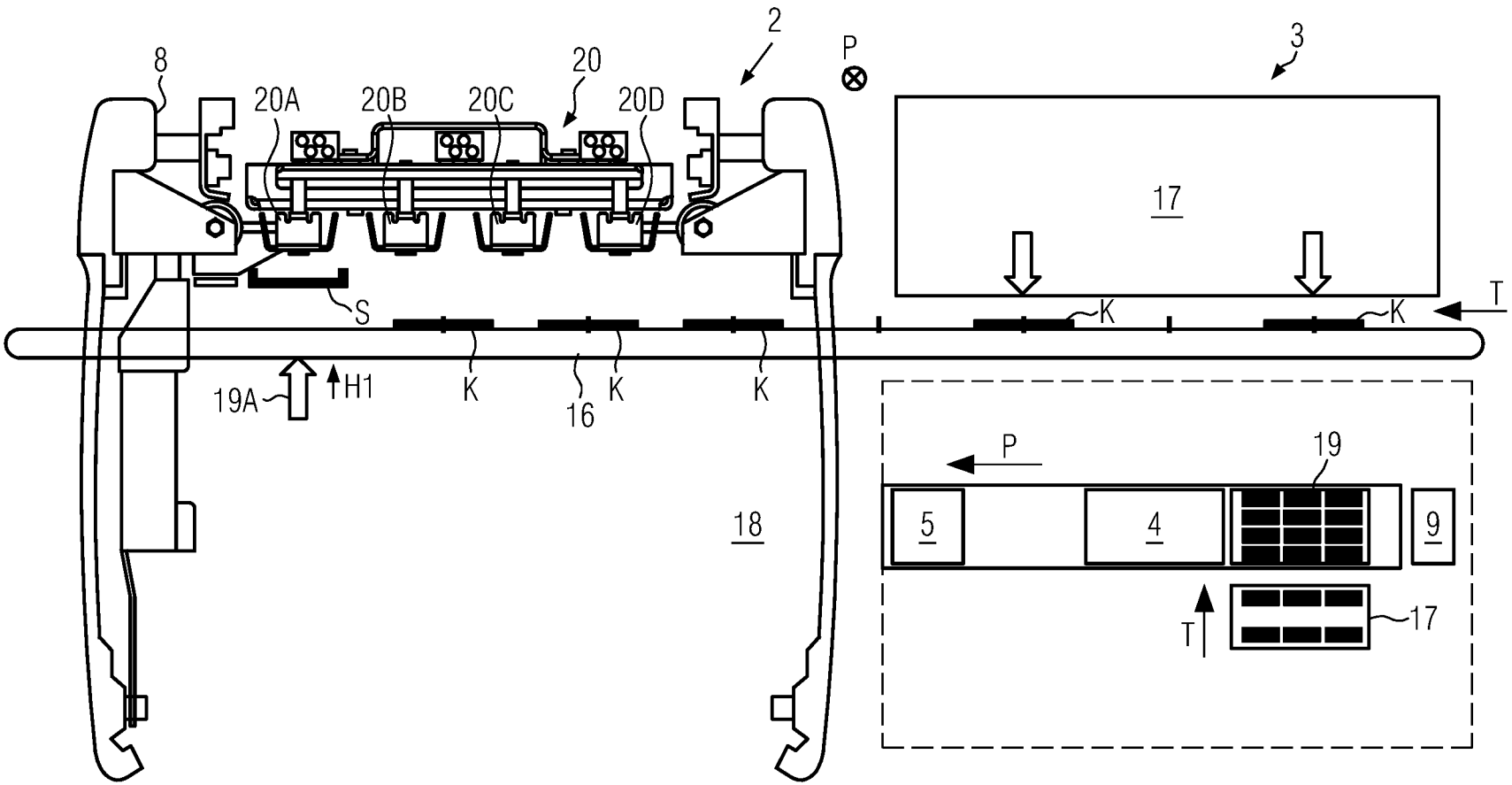

FIG. 4F shows that the cardboard blank K shown in the transfer position P1 in FIG. 4E is adjusted in height in lifting direction H1 by means of the lifting unit 19A arranged below it. During this lifting movement, the cardboard blank K is folded and positioned as tray part S in transfer position P2. At this point, two further cardboard blanks K, i.e., two further rows of cardboard blanks K, are already deposited on the transport belt device 16 by the destacker 17.

Figure 4G:
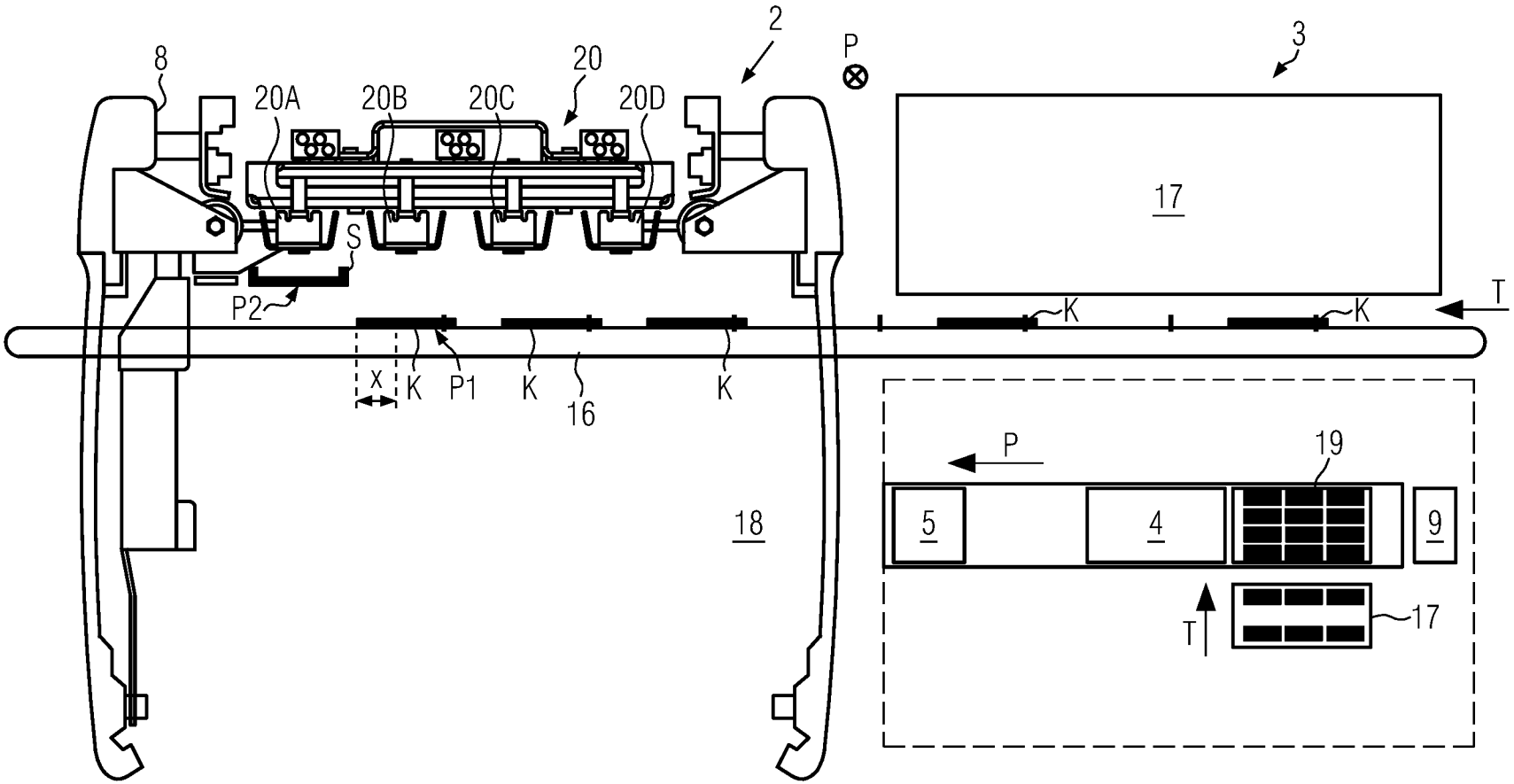

FIG. 4G shows that the cardboard blank K positioned immediately behind the first cardboard blank K in the transport direction T has moved to its collection position P1 within the transfer area 18 in the transport direction T. The cardboard blanks K positioned behind them are not yet positioned in their respective collection positions P1. FIG. 4G shows that the cardboard blank K present in the collection position P1 is advanced by a distance x in order to have a desired division TS (see FIG. 4H) with respect to the preceding tray part S, which corresponds to the lane division present in the production direction P of the deep-drawing packaging machine 2.

Figure 4H:
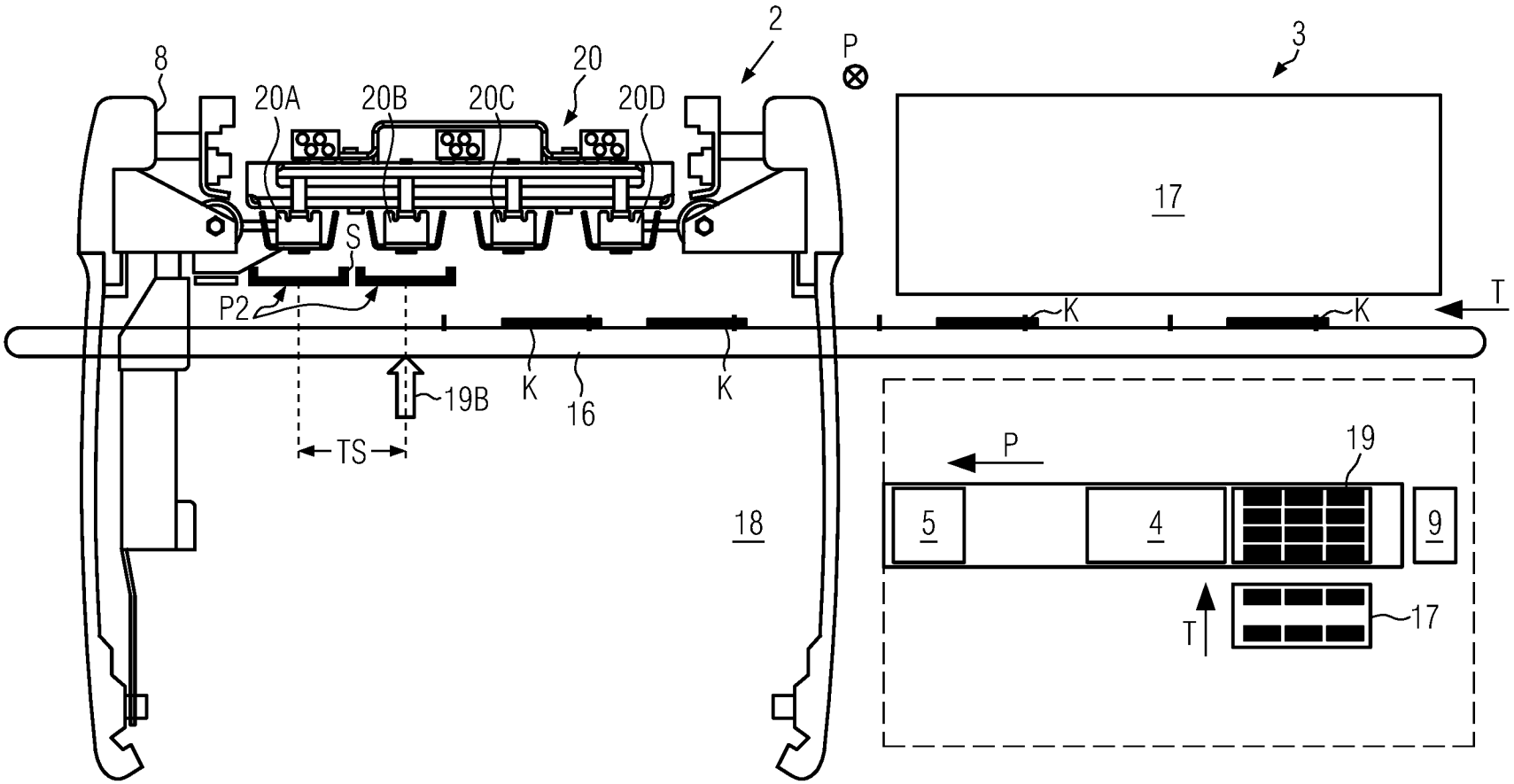

FIG. 4H shows that the second cardboard blank K is lifted by the lifting unit 19B mounted at the second position in the transport direction T and is present as a tray part S in the transfer position P2.

Figure 4I:
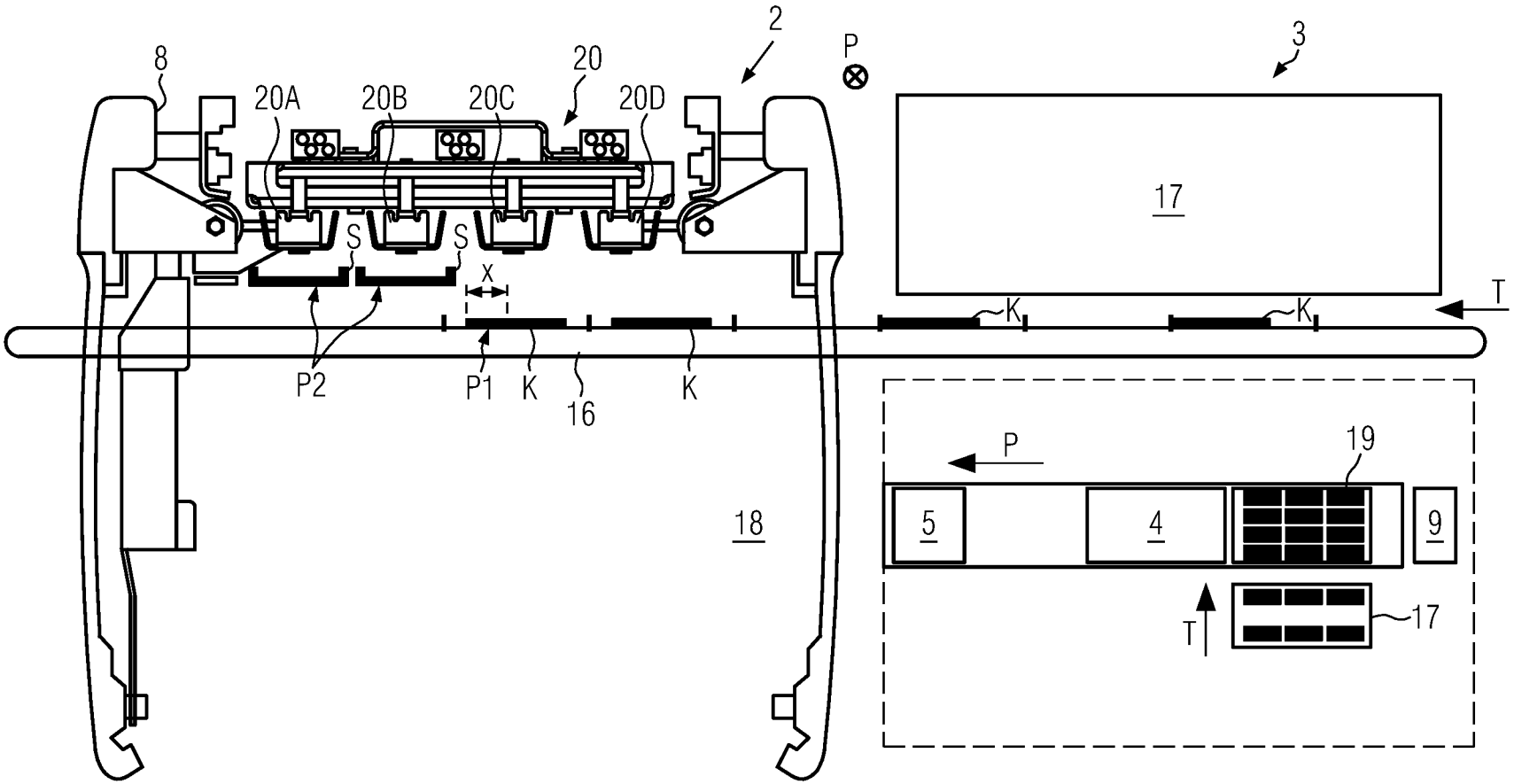

Now, as shown in FIG. 4I, the cardboard blank K positioned at the penultimate position in the row is advanced by the distance x so that it is aligned in its collection position P1 below the gripper unit 20C or above the lifting unit 19C. The rows of cardboard blanks K delivered to the transport belt device 16 by the destacker 17 at this point are moved such that two further rows of cardboard blanks K can be transferred from the destacker 17 to the transport belt device 16.

Figure 4J:
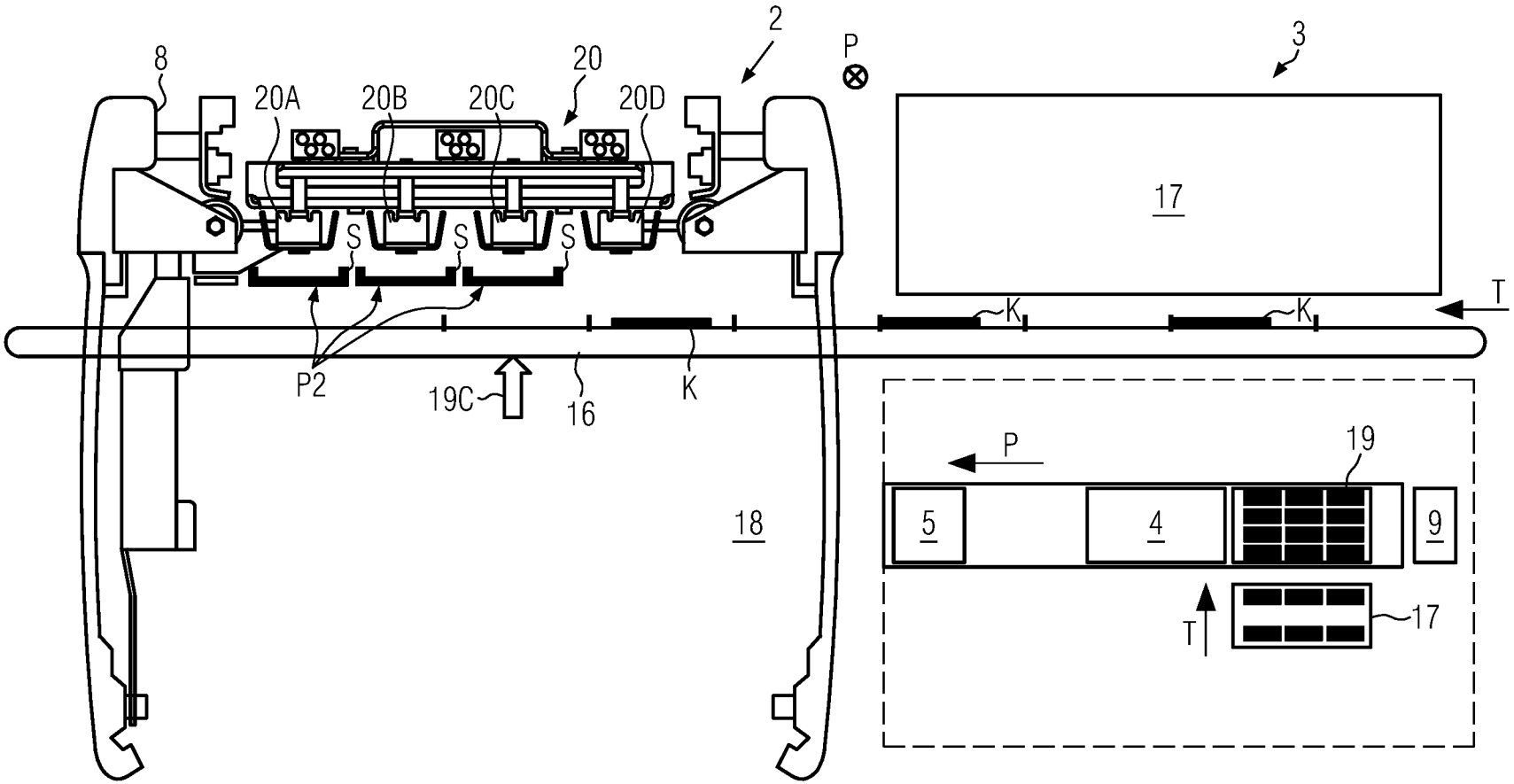
Figure 4K:
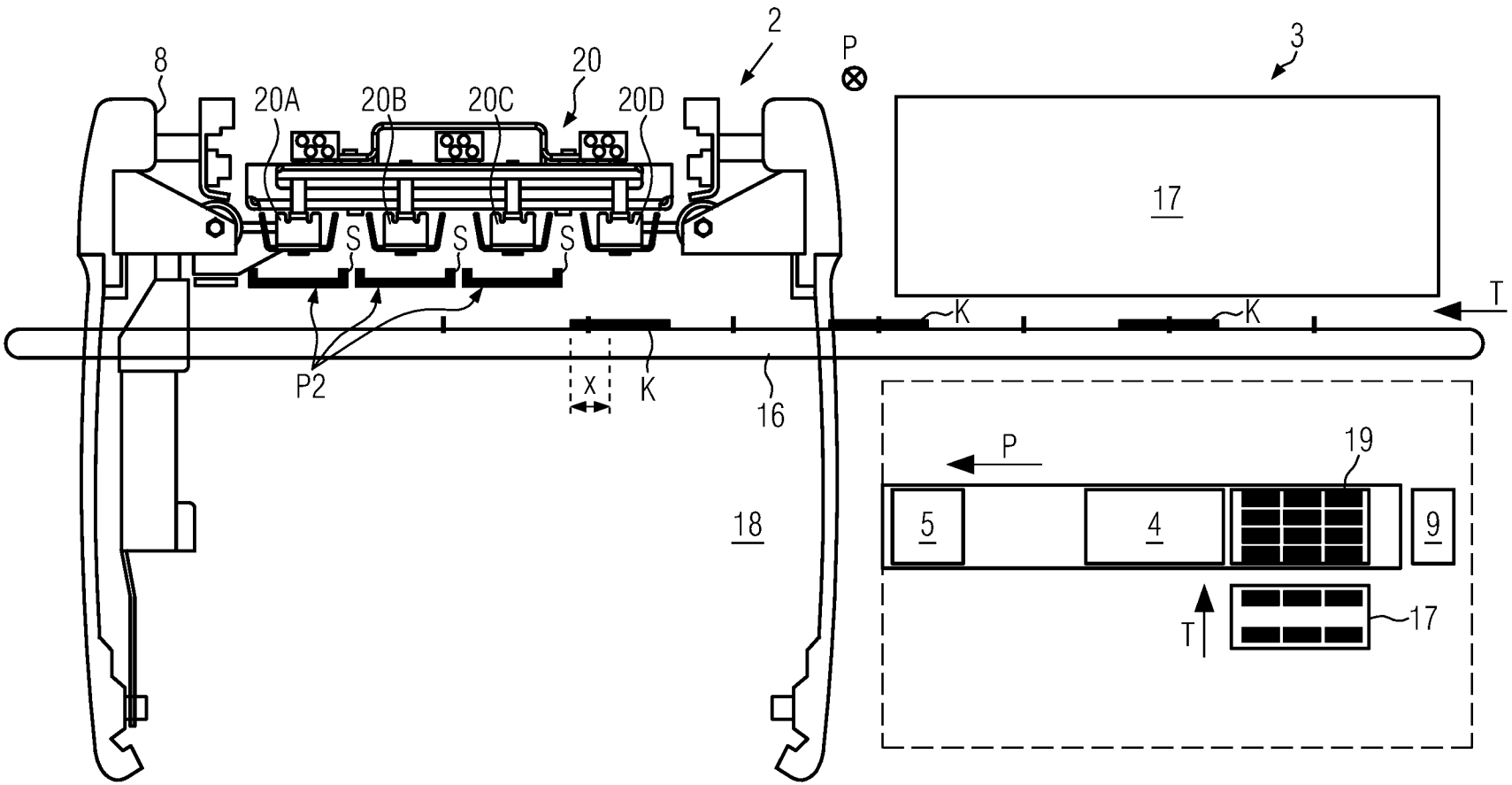

FIG. 4J now shows that three tray parts S are already arranged in their transfer positions P2. According to FIG. 4K, the last cardboard blank K or the last row of cardboard blanks K positioned within the transfer area 18 has moved to its collection position P1. Here, too, the row of cardboard blanks K moves again by the distance x to be positioned according to the division TS.

Figure 4L:
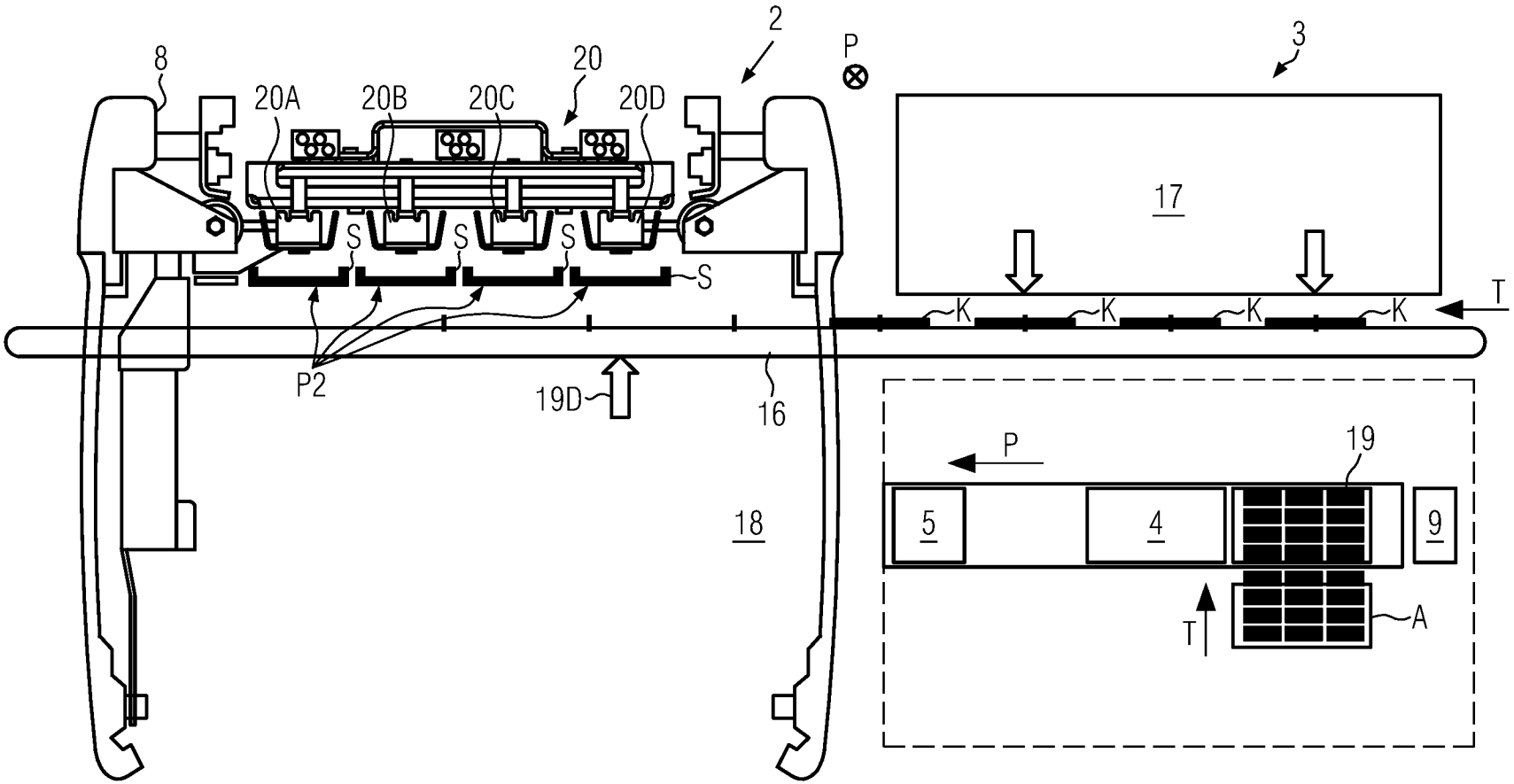
Figure 4M:
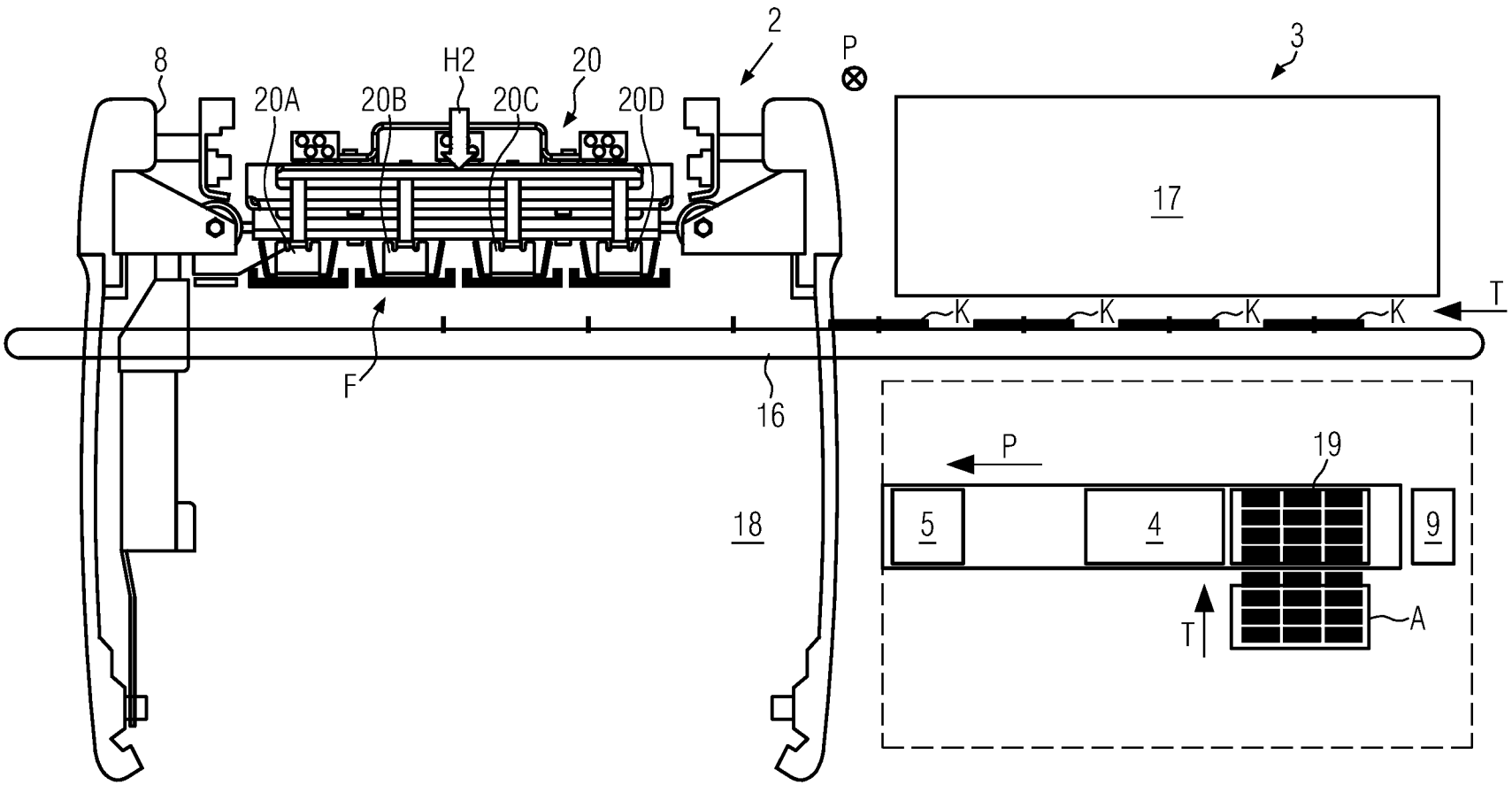

FIG. 4L shows that the last row of cardboard blanks K has been lifted by the lifting unit 19D into the transfer position P2 and folded. Now, all cardboard blanks K provided by the transport belt device 16 within the transfer area 18 are positioned in its transfer position P2. Outside the deep-drawing packaging machine 2, further cardboard blanks K are already fully deposited in the initial format A on the transport belt device 16 and are waiting to be transported to the transfer area 18. FIG. 4M shows that the respective gripper units 20A to 20D are simultaneously lowered in the lifting direction H2 to collect the tray parts S positioned in a predetermined packaging format F in the transfer positions P2.

Figure 4N:
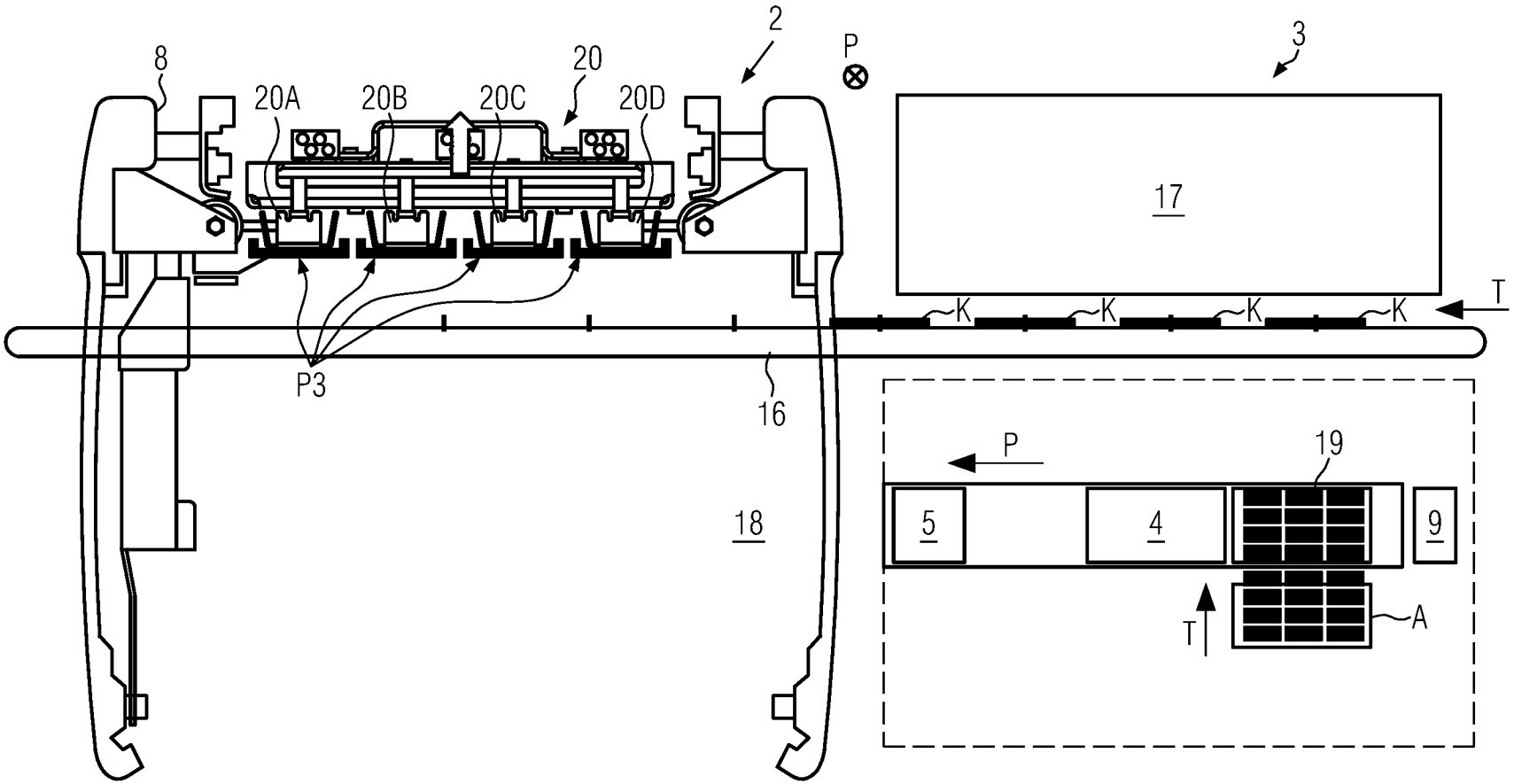
Figure 40:
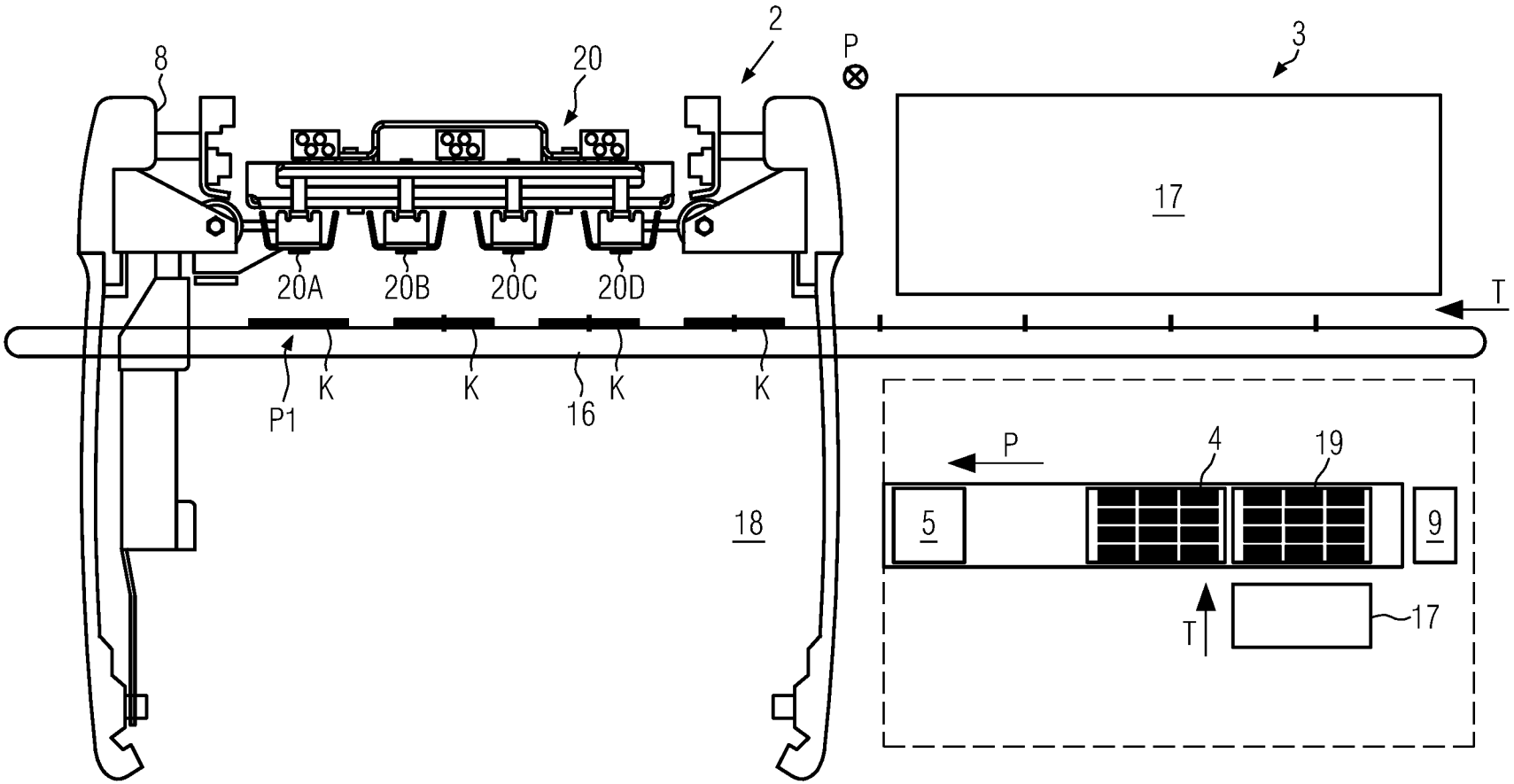

FIG. 4N shows that the tray parts S are lifted by the gripper device 20 into its traverse positions P3. Next, the gripper device 20 moves the tray parts S collected thereon in the production direction P to the forming station 4. In the forming station 4, the tray parts S deposited in the predetermined packaging format F are connected to the troughs M deep-drawn therein in order to leave the forming station 4 in the direction of the sealing station 5 as composite packaging lower parts VU.

Finally, FIG. 4O shows that the rows of cardboard blanks K deposited outside the deep-drawing packaging machine 2 in the initial format A are transported to the transfer area 18 to be sequentially positioned, collected, lifted, folded and transferred therein to the gripper device 20 in the form of tray parts S as described above.

What is claimed is:

1. A packaging system comprising a deep-drawing packaging machine configured to produce packages in a production direction, and a feeding system for the deep-drawing packaging machine, wherein the feeding system comprises a transport belt device configured to transport cardboard blanks in a transport direction that is transverse to the production direction of the deep-drawing packaging machine into a transfer area formed within a machine frame of the deep-drawing packaging machine, wherein the feeding system comprises a lifting device arranged in the transfer area for collecting and lifting the cardboard blanks transported into the transfer area by the transport belt device, and wherein the lifting device has a plurality of independently controllable lifting units positioned one behind the other in the transport direction.

2. The packaging system according to claim 1, wherein the lifting units positioned one behind the other in the transfer area in the transport direction, starting with the lifting unit positioned at a front in the transport direction, can be controlled individually one after the other for lifting respective cardboard blanks.

3. The packaging system according to claim 1, wherein the lifting units are each configured for collecting and lifting a plurality of cardboard blanks positioned next to one another transversely to the transport direction.

4. The packaging system according to claim 1, wherein the lifting units each have at least one folding tool for producing tray parts from respective cardboard blanks collected at the lifting units.

5. The packaging system according to claim 1, wherein the lifting units are separately pneumatically controllable.

6. The packaging system according to claim 1, wherein the feeding system in the transfer area has at least one adjustable positioning device associated with the transport belt device for aligning the cardboard blanks transported by the transport belt device into the transfer area.

7. The packaging system according to claim 1, wherein the feeding system comprises a gripper device mounted within the machine frame of the deep-drawing packaging machine and adjustable between the transfer area and a forming station of the deep- drawing packaging machine.

8. The packaging system according to claim 7, wherein the gripper device has a plurality of gripper units which can be jointly adjusted in height and/or a plurality of gripper units which can be adjusted relative to one another in the production direction.

9. The packaging system according to claim 1, wherein the transport belt device comprises a conveyor belt.

10. A method for feeding cardboard blanks arranged in a row one behind the other relative to a transport direction into a transfer area formed within a machine frame of a deep-drawing packaging machine that is configured to produce packages in a production direction transverse to the transport direction, the method comprising:

transporting a cardboard blank, which is positioned in the row, inside the transfer area in the transport direction into a first collection position; and lifting the cardboard blank out of the first collection position before another cardboard blank, which is positioned immediately behind the cardboard blank in the row relative to the transport direction, advances inside the transfer area in the transport direction into a second collection position;

wherein the transporting is performed by a transport belt device of a feeding system for the deep-drawing packaging machine, the transport belt device being configured to transport the cardboard blanks in the transport direction, wherein the lifting is performed by a lifting device of the feeding system, the lifting device being arranged in the transfer area for collecting and lifting the cardboard blanks transported into the transfer area by the transport belt device, and the lifting device having a plurality of independently controllable lifting units positioned one behind the other in the transport direction.

11. The method according to claim 10, further comprising folding the cardboard blank into a tray part and moving the tray part into a first transfer position before the another cardboard blank positioned immediately behind the cardboard blank in the row advances within the transfer area in the transport direction into the second collection position.

12. The method according to claim 10, wherein a plurality of rows formed side by side in the transport direction with cardboard blanks positioned one behind the other therein are simultaneously transported into the transfer area in an initial format, wherein a plurality of first cardboard blanks positioned adjacent each other transversely to the transport direction are transported simultaneously with one another in the transport direction into respective first mutually adjacent collection positions, lifted out of the first mutually adjacent collection positions, folded and moved as tray parts into respective first mutually adjacent transfer positions, before a plurality of adjacent second cardboard blanks positioned immediately behind the plurality of first cardboard blanks move simultaneously with one another in the transport direction into respective second mutually adjacent collection positions, and are lifted out of the second mutually adjacent collection positions, folded and moved as tray parts into respective second mutually adjacent transfer positions.

13. A packaging system comprising:

a deep-drawing packaging machine configured to produce packages in a production direction, the deep-drawing packaging machine including a transfer area; and a feeding system for the deep-drawing packaging machine, the feeding system including a transport device configured to transport cardboard blanks in a transport direction that is transverse to the production direction of the deep-drawing packaging machine into the transfer area, and a lifting device arranged in the transfer area and configured to collect and lift the cardboard blanks transported into the transfer area by the transport device, wherein the lifting device includes multiple lifting units that are arranged in the transport direction and that are controllable independently of each other.

14. The packaging system according to claim 13, wherein the multiple lifting units are positioned one behind the other in the transport direction.

15. The packaging system according to claim 14, wherein the lifting units positioned one behind the other in the transfer area in the transport direction, starting with the lifting unit positioned at a front in the transport direction, are controllable individually one after another for lifting respective cardboard blanks.

16. The packaging system according to claim 13, wherein the lifting units are each configured to collect and lift a plurality of cardboard blanks positioned next to one another transversely to the transport direction.

17. The packaging system according to claim 13, wherein the lifting units each have at least one folding tool for producing tray parts from respective cardboard blanks collected at the lifting units.

18. The packaging system according to claim 13, wherein the lifting units are separately pneumatically controllable.

19. The packaging system according to claim 13, wherein the feeding system in the transfer area has at least one adjustable positioning device associated with the transport device for for aligning the cardboard blanks transported by the transport device into the transfer area.

20. The packaging system according to claim 13, wherein the deep- drawing packaging machine comprises a forming station configured to form troughs in a film, and the feeding system comprises a gripper device that is adjustable between the transfer area and the forming station.

* * * * *